United States Patent [19]

Rammos

[11] Patent Number: 4,720,691

[45] Date of Patent: Jan. 19, 1988

[54] COMPACT WAVEGUIDE APPARATUS ACTING AS A MAGIC T

[75] Inventor: Emmanuel Rammos, Oegstgeest, Netherlands

[73] Assignee: Agence Spatiale Europeenne, France

[21] Appl. No.: 903,759

[22] Filed: Sep. 4, 1986

[30] Foreign Application Priority Data

Sep. 13, 1985 [FR] France ..... 85 14091

[51] Int. Cl.[4] ..... H01P 5/20

[52] U.S. Cl. ..... 333/122; 333/125; 342/134

[58] Field of Search ..... 333/117, 121, 122, 125, 333/126, 135, 137, 21 A

[56] References Cited

U.S. PATENT DOCUMENTS 2,973,486 2/1961 Salzberg ..... 333/122

4,395,685 7/1983 Davies et al. ..... 333/21 A X

*Primary Examiner*—Paul Gensler

*Attorney, Agent, or Firm*—Fred A. Keire

[57] ABSTRACT

A rectilinear waveguide junction apparatus in which the input and output guides are parallel to the longitudinal axis of the apparatus. This apparatus is characterized in that it takes the form of a parallelipiped guide the internal volume of which is divided up by metal partitions which form two parallel input guides, two parallel output guides and a main intermediate guide of same section as the parallelipiped guide. This apparatus is used in very high frequency circuits, for example the supply circuits for satellite or radar antennae.

5 Claims, 10 Drawing Figures

FIG. 1
PRIOR ART
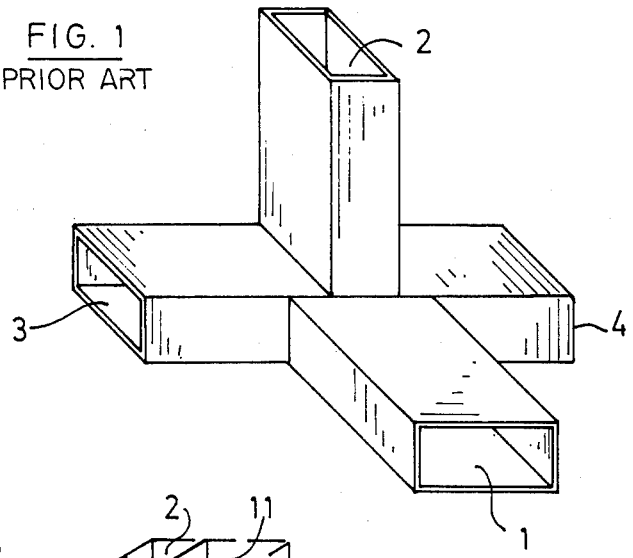
FIG. 2
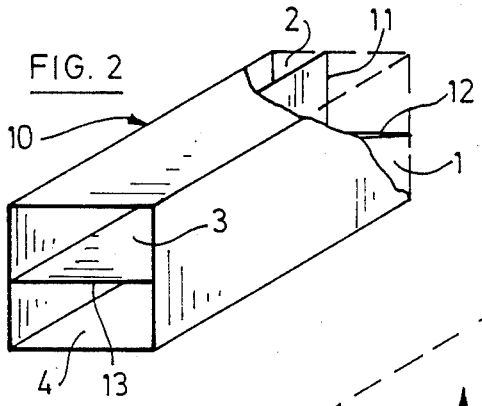
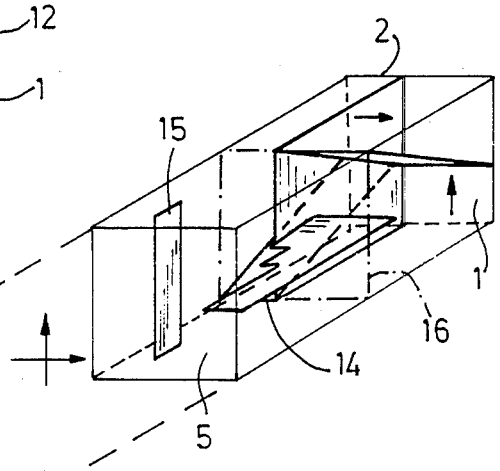
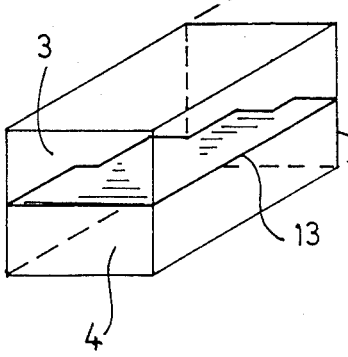
FIG. 3

COMPACT WAVEGUIDE APPARATUS ACTING AS A MAGIC T

BACKGROUND OF THE INVENTION

The invention relates to a compact waveguide junction apparatus functioning as a magic T.

Magic Ts are often used in very high frequency circuits, especially the supply circuits for satellite or radar antennae when these antennae are to be used in tracking mode.

Several types of magic T waveguide junctions are known in the prior art and all have at least one output which is perpendicular to the main axis of the apparatus. FIG. 1 shows an example of a typical magic T according to the prior art. The access gates or the waveguides are designated 1, 2, 3 and 4. As it excites the gate 1, the wave power is divided between gates 3 and 4 which deliver signals in phase whereas gate 2 is isolated. When gate 2 is excited, it is gate 1 which is isolated and the wave power is divided between gates 3 and 4, but this time the output signals are in phase opposition. The operation is represented by the matrix $S_{ij}$:

$$S_{ij} = \frac{j}{\sqrt{2}} \begin{vmatrix} 0 & 0 & 1 & 1 \\ 0 & 0 & -1 & 1 \\ 1 & -1 & 0 & 0 \\ 1 & 1 & 0 & 0 \end{vmatrix}$$

The magic Ts necessary to produce a distance-measuring or tracking circuit and particularly the guides required to establish interconnections between the magic Ts are very bulky because the different output guides of a magic T are not arranged with their axes parallel to one another.

SUMMARY OF THE INVENTION

This invention relates to a compact apparatus operating as a magic T and having its four input and output waveguides parallel to the longitudinal axis of the apparatus.

This apparatus according to the invention consists of a parallelipiped guide the internal volume of which is divided into two first rectangular waveguides by at least one metal partition extending between a first end of the guide and a first plane of upright section, and into two second rectangular waveguides by a septum extending between the second end of the guide and a second plane of upright section, the volume contained between the two planes of upright section mentioned above forming a fifth waveguide capable of supporting an electromagnetic wave in two perpendicular polarization modes, the four rectangular waveguies having their axes parallel to one another and being arranged in alignment with the fifth waveguide, said rectangular waveguides having dimensions such that they are capable of supporting, on the one hand, the propagation of a wave with horizontal linear polarization and on the other hand, the propagation of a wave with vertical linear polarization, the fifth waveguide comprising a mode cutoff device positioned on the axis of one of the first rectangular waveguides so as to prevent any undesirable linear polarization mode in the above-mentioned waveguide.

The internal metal partitions may be arranged so as to form the inner walls of one or two linear polarization guides of variable cross section.

By its compact rectilinear construction, the apparatus according to the invention brings about a remarkable simplification in the circuits of complex waveguides such as tracking systems or distance-measuring circuits for satellite or radar antennae, for example.

The invention is hereinafter explained with reference to the accompanying drawings.

BRIEF DESCRIPTION OF THE DRAWINGS

FIG. 1 shows a typical magic T according to the prior art,

FIG. 2 is a perspective view of a waveguide apparatus according to the invention, FIG. 3 is an exploded view of the apparatus according to FIG. 2, FIGS. 4 and 5 show the conversion of a signal in the apparatus of FIG. 2, FIGS. 6 and 7 show the combination of signals in the apparatus of FIG. 2.

FIG. 10 is a perspective view of a waveguide apparatus according to the invention with parts broken away and shows a cutoff device having an edge with a profile in the form of a cosine squared curved.

DESCRIPTION OF EXEMPLARY EMBODIMENTS OF THE INVENTION

Figure 4:
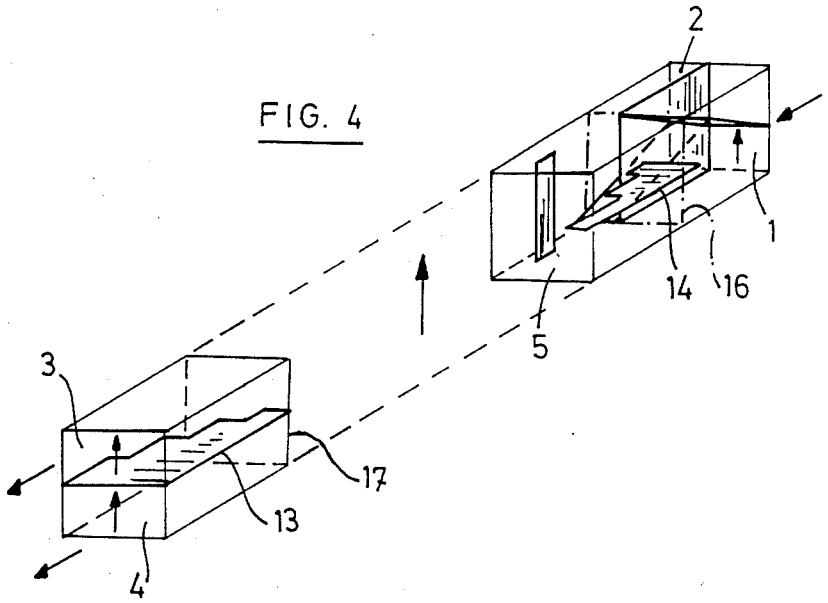

As shown in FIG. 2, the apparatus according to the invention is in the form of a parallelipiped guide 10. The internal volume of the guide 10 is arranged to form two first rectangular guides 1 and 2 at one end of the guide 10 and two second rectangular guides 3 and 4 at the other end of the guide 10. The first rectangular guides 1 and 2 are tapered and extend between one end of the guide 10, where their sections are compatible with standard waveguides, and a connection plane designated 16 in the exploded view in FIG. 3 and they are bounded by internal metal partitions 11 and 12. The second rectangular guides 3 and 4 extend between the other end of the guide 10 and a connection plane designated 17 in the exploded view in FIG. 3 and they are separated by a horizontal septum 13. Between the planes of upright section 16 and 17 there is a main guide 5 having the same section as the parallelipiped guide 10.

The dimensions of the section of the main guide 5 and consequently those of the cross section of the apparatus are such that the main guide 5 is capable of supporting the propagation of an electromagnetic wave with two perpendicular polarization modes H and V, with horizontal and vertical electric fields, respectively, for example the modes TE01 and TE10. The main guide 5 is shown with a square cross section to keep the drawings simple. The dimensions of the square section are usually of the order of $1\lambda \times 1\lambda$ ($\lambda$ represents the wavelength used for propagation).

The sections of the rectangular guides 1 and 2 are designed to allow the propagation of a polarization mode having a vertical electric field in the guide 1 and a polarization mode with a horizontal electric field in the guide 2. At the cross-section plane 16, the section of the guide 2 is, for example, $1\lambda \times 0.4\lambda$ and that of the guide 1 is $1\lambda \times 0.6\lambda$. The cross sections of these rectangular guides then taper to the desired (e.g. standard) cross sections toward the end of the guide 10. The horizontal dimension (0.4λ) of the guide 2 prevents propagation of the polarization mode with a vertical electric field. A vertical blade 15 arranged in the main guide 5 serves to adapt the impedance between the guide 2 and the guide 5. A plurality of adaptation blades may be provided. A horizontal blade 14 arranged in the main guide 5 serves to suppress the undesirable, i.e., horizonal polarization mode in the guide 1. The blade 14 has an edge, for example, with a stepped profile as shown in the drawings, but this edge may also have a different profile, for example a cosine squared curve. FIG. 10 shows a blade 14' having an edge 18 with this particular profile.

In the embodiment shown, the rectangular guides 1 and 2 have a variable section, i.e., they are tapered waveguides) but the internal walls 11 and 12 may be arranged so as to define rectangular guides of constant section.

The method of operation of the apparatus will now be described, referring to FIGS. 4 through 7 successively. When the gate 1 is excited (vertical polarization wave TE10), the main guide 5 guides a wave with a vertical electric field which is separated, by the septum 13, into two waves of vertical polarization having the same amplitude and same phase (FIG. 4). Signals of equal amplitude and in phase are then obtained at the gates 3 and 4. No signals are propagated towards the gate 2 because the rectangular guide 2 can only guide waves with horizontal polarization.

Figure 5:
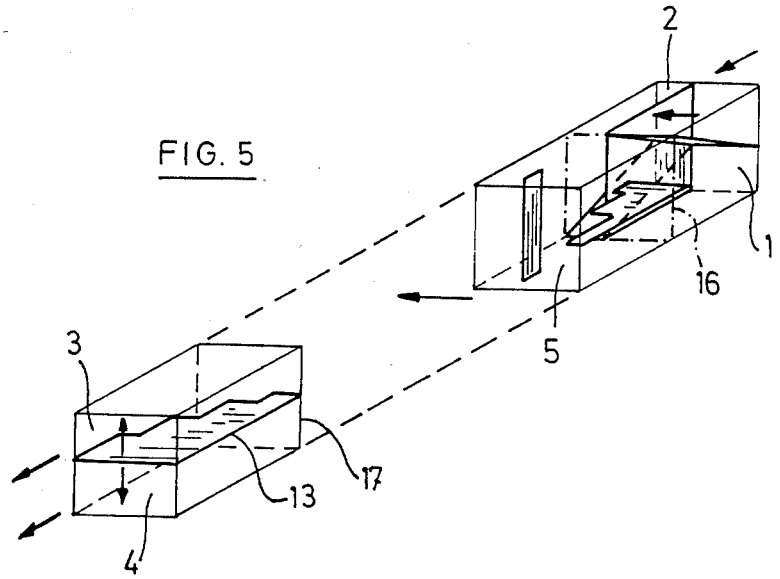
Figure 6:
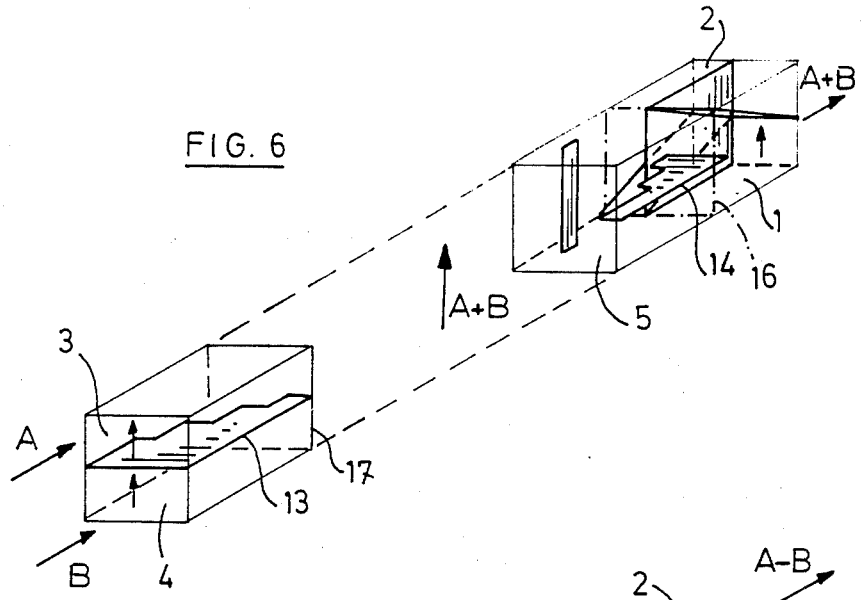
Figure 7:
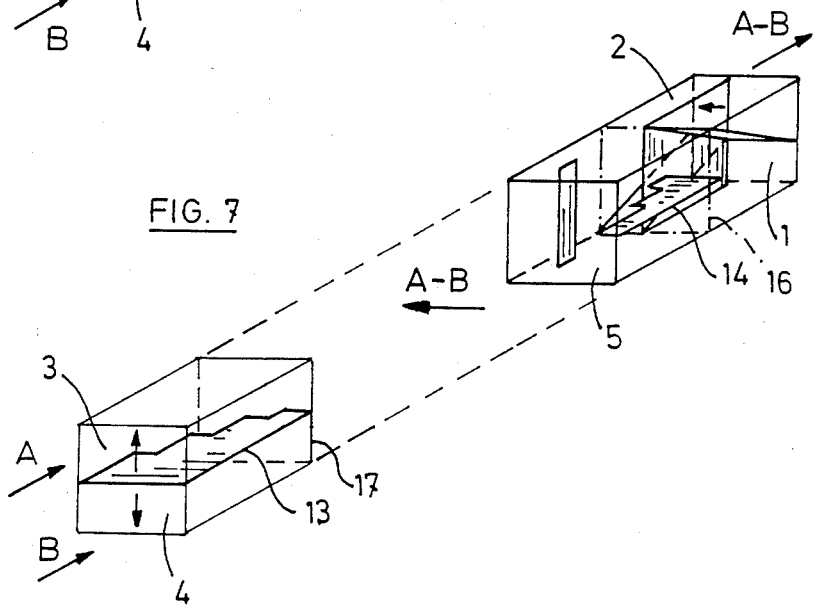

When the gate 2 is excited (horizontal polarization wave TE01), the main guide 5 guides a wave with a horizontal electric field which is separated by the septum 13 into two waves having the same amplitude and opposite phases (FIG. 5). Signals of the same amplitude but in phase opposition are then obtained at gates 3 and 4.

The function of the septum in the propagation of electromagnetic waves is analysed by Ming Hui Chen and G. N. Tsandoulas in an article entitled "A Wideband Square-Waveguide Array Polarizer", published in IEEE Transactions on Antennas and Propagation, May 1973, pages 389–391.

When the gates 3 and 4 are excited by in-phase waves with vertical polarization (FIG. 6), the main guide 5 is the seat of a wave of double amplitude which is the sum of the input signals and this wave is propagated in the guide 1 which is the only one capable of supporting a vertical polarization wave (the guide 2 cannot support a vertical polarization wave owing to the fact that its horizontal dimension is less than half a wavelength). Therefore, a signal equal to the sum of the input signals is obtained at the gate 1.

When the gates 3 and 4 are excited by waves of vertical polarization with opposite phases (FIG. 7), the main guide 5 is the seat of a wave of horizonal polarization which is equal to the difference between the input signals and this wave is propagated in the guide 2 (the wave of horizontal polarization is cut off at the entrance to the guide 1 by the cutoff blade 14). Therefore, a signal equal to the difference between the input signals is obtained at the gate 2.

The apparatus according to the invention therefore operates as a magic T with the characteristic advantage of having all its input and output guides parallel to one another in a compact rectilinear structure. Obviously, the septums or blades 13 and 14 must be optimum in order to ensure excellent isolation between the gates 1 and 2. Isolation of at least 26 dB over 20 percent of the frequency band can be achieved with a septum having a suitably adapted stepped edge. Research is in progress in the applicant's laboratories to improve on these performances.

Figure 9:
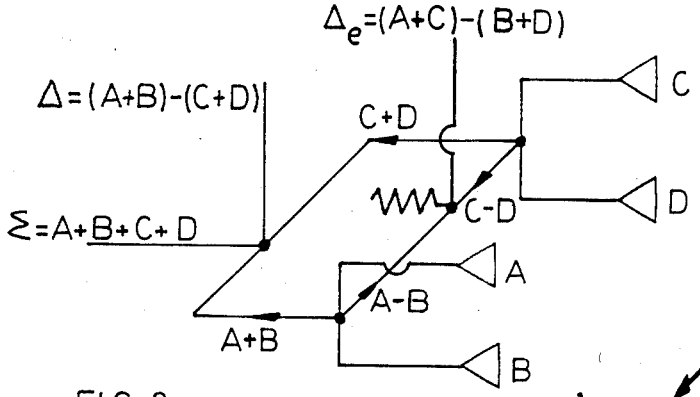
FIG. 9 is a diagram representing the apparatus of FIG. 8.
Figure 8:
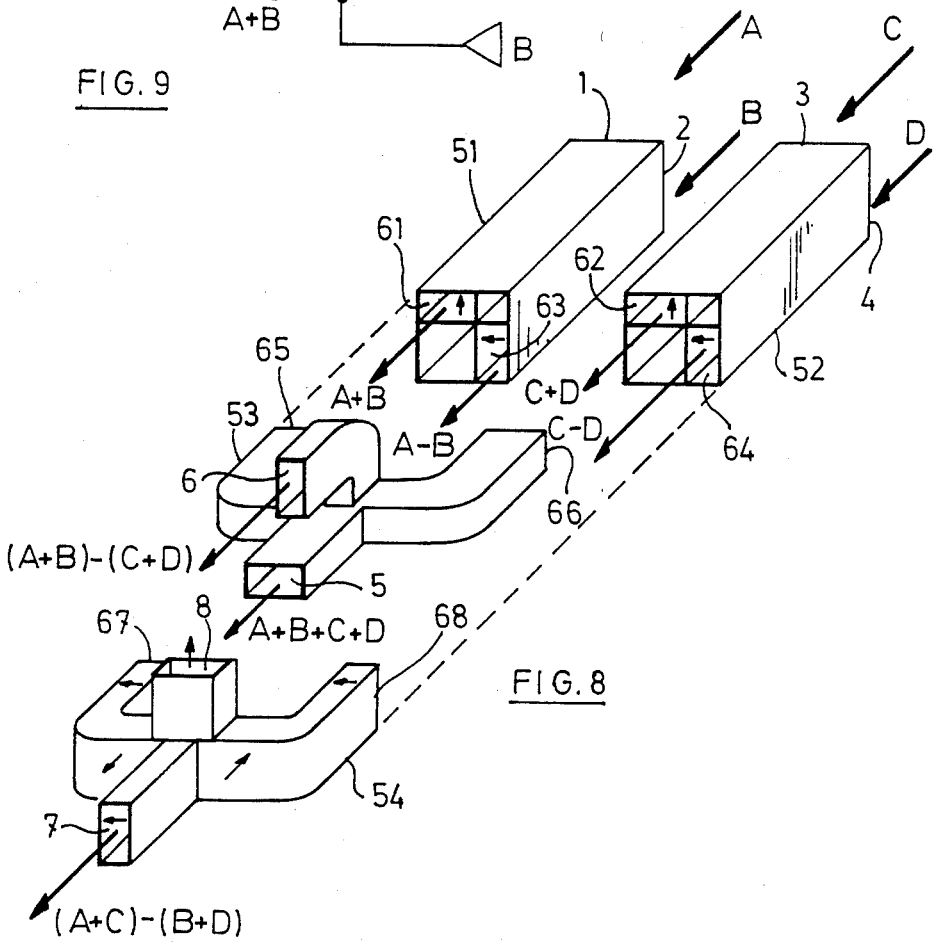
FIG. 8 is an exploded view of an embodiment incorporating two apparatus according to the invention in conjunction with conventional apparatus.

The apparatus according to the invention can be used to spectacular effect in complex waveguide configurations such as tracking systems or distance-measuring circuits for satellite or radar antennae. An embodiment of a distance measuring circuit is diagrammatically shown in FIG. 8, in the case of a monopulse apparatus. This circuit is made up of two apparatus according to the invention 51, 52 and two conventional magic Ts 53, 54. The input gates of the circuit are designated 1, 2, 3 and 4 and the output gates are designated 5, 6, 7 and 8. The gate 61 of the guide 51 is connected to the gate 65 of the T 53 and the gate 63 is connected to the gate 67 of the T 54. The gate 62 of the guide 52 is connected to the gate 66 of the T 53 and the gate 64 is connected to the gate 68 of the T 54. FIG. 9 shows a representative diagram of the circuit of FIG. 8. With A, B, C and D denoting the waves applied to the input gates 1, 2, 3 and 4 respectively, the signals produced by the apparatus 51 and 52 according to the invention are

| | |
|---|---|
| Gate 61 | A + B |
| Gate 62 | C + D |
| Gate 63 | A − B |
| Gate 64 | C − D |

The following signals are obtained at the output gates of the circuit:

| | |
|---|---|
| Gate 5 | A + B + C + D |
| Gate 6 | (A + B) − (C + D) |
| Gate 7 | (A + C) − (B + D) |
| Gate 8 | connected to a matched load |

Compared with equivalent distance-measuring circuits using conventional magic Ts, the construction according to the invention is distinguished by its noticeable compactness.

Although particular illustrative embodiments of the present invention have been described herein with reference to the accompanying drawings, the present invention is not limited to these particular embodiments. Various changes and modifications may be made thereto by those skilled in the art without departing from the spirit or scope of the invention, which is defined by the appended claims.

I claim:

1. Waveguide apparatus serving as a magic T, comprising a parallelipiped guide, the internal volume of said guide being divided into two first rectangular waveguides by at least one metal partition extending between a first end of the guide and a first cross-sectional plane, and into two second rectangular waveguides by a septum extending between the second end of the guide and a second cross-sectional plane, the volume contained between the first and second cross-sectional planes forming a fifth waveguide capable of supporting an electromagnetic wave with two perpendicular polarization modes, said two first and said two second rectangular waveguides having their axes parallel to one another and being arranged in alignment with the fifth waveguide, said first rectangular waveguides being of such dimensions that one of them is capable of supporting propagation of a wave of vertical linear polarization and the other one is capable of supporting propagation of a wave of horizontal linear polarization, the fifth waveguide comprising a mode cutoff device positioned on the axis of one of the first rectangular waveguides so as to suppress any undesirable linear polarization mode therein.

2. Apparatus as claimed in claim 1, wherein the cutoff device is a metal blade with an edge having a stepped profile.

3. Apparatus as claimed in claim 1, wherein the cutoff device is a metal blade having an edge with a profile in the form of a cosine squared curve.

4. Apparatus as claimed in claim 1, characterized in that it further comprises a device for adapting the impedance between the fifth waveguide and one of the first waveguides.

5. Apparatus as claimed in claim 1, characterized in that at least one internal metal partition is arranged so as to define an inner wall of a linear polarization guide of variable cross section inside said parallelipiped guide.

* * * * *